United States Patent [19]

Mumford

[11] 4,383,620

[45] May 17, 1983

[54] CONTAINER AND CLOSURE

[75] Inventor: George V. Mumford, Toledo, Ohio

[73] Assignee: Owens-Illinois, Inc., Toledo, Ohio

[21] Appl. No.: 323,503

[22] Filed: Nov. 23, 1981

[51] Int. Cl.[3] ..... B65D 41/04

[52] U.S. Cl. ..... 215/329; 215/270; 215/341; 215/344; 215/DIG. 1

[58] Field of Search ..... 215/341, 344, DIG. 1, 215/270, 329

[56] References Cited

U.S. PATENT DOCUMENTS

| | | | |
|---|---|---|---|
| 2,752,059 | 6/1956 | Schneider | 215/DIG. 1 |
| 3,224,617 | 12/1965 | Hohl et al. | 215/341 X |
| 4,209,102 | 6/1980 | Dunn et al. | 215/341 X |

FOREIGN PATENT DOCUMENTS

| | | | |
|---|---|---|---|
| 2641543 | 3/1977 | Fed. Rep. of Germany | 215/270 |
| 1485328 | 5/1967 | France | 215/341 |
| 583120 | 12/1976 | Switzerland | 215/341 |

*Primary Examiner*—Donald F. Norton

*Attorney, Agent, or Firm*—John R. Nelson; Myron E. Click; David H. Wilson

[57] ABSTRACT

A package comprising a container and a molded plastic closure. The container neck has external threads formed thereon and an external frustoconical sealing surface formed above said threads and extending upwardly and radially inwardly. The closure comprises a panel and an integral depending annular skirt, the skirt having integral internal threads formed thereon complementary to the threads on the neck of the container. An integral annular side sealing rib extends radially inwardly from the inner surface of the skirt and engages the external frustoconical sealing surface of the container in an interference fit such that when the closure is threaded on the container, the rib is compressed into sealing relation with the external frustoconical sealing surface. The panel portion of the closure includes a portion adapted to engage the end of the neck of the container to form a top seal. The closure includes a flexible annular wall integrally connecting the periphery of the panel and the sealing rib.

2 Claims, 4 Drawing Figures

CONTAINER AND CLOSURE

This invention relates to packages for containing pressurized fluids.

BACKGROUND AND SUMMARY OF THE INVENTION

In my copending application Ser. No. 114,032, filed Jan. 21, 1980, now U.S. Pat. No. 4,322,011, there is disclosed and claimed a plastic closure for sealing a container of pressurized fluid wherein the closure has a panel and integral skirt defining internal threads cooperating with the threads of the container and an annular side sealing rib extending inwardly from the inside surface of the skirt above the threads and dimensioned to form an interference fit with an external cylindrical sealing wall of the container and a flexible annular wall integrally connecting the periphery of the panel and the side sealing rib.

Among the objectives of the present invention are to provide an improved package of this type which will accommodate for tolerances in the manufacture of the closure and container.

In accordance with the invention, the container neck has an external frustoconical sealing surface formed above the threads and extending upwardly and radially inwardly, and the molded plastic closure has an integral annular side sealing rib extending radially inwardly from the inner surface of said skirt and engageable with the external frustoconical sealing surface of the container in an interference fit such that when the closure is threaded on the container, the rib is compressed into sealing relation with the external frustoconical sealing surface and a flexible annular wall integrally connecting the periphery of the panel and the sealing rib flexes.

DESCRIPTION

Figure 1:
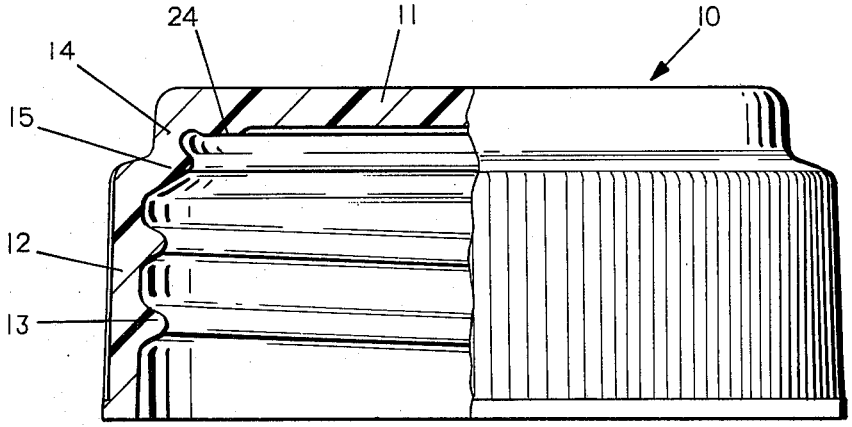
FIG. 1 is a part sectional elevational view of a closure embodying the invention.
Figure 3:
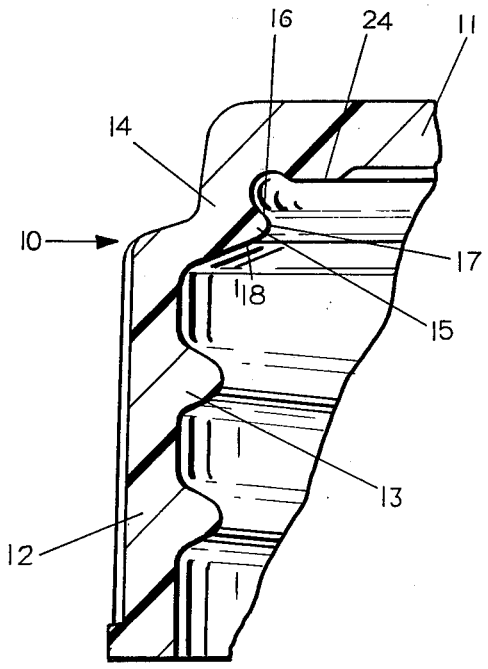
FIG. 3 is a fragmentary sectional view on an enlarged scale of a portion of the closure.

Referring to FIG. 1, the closure 10 comprises a generally flat top panel 11 and a peripheral skirt 12 having integral internal threads 13 extending radially inwardly. The top panel 11 is connected to the skirt 12 by an integral axially extending flexible wall 14 that extends axially and an annular rib 15 extends radially inwardly from the skirt above the threads. As shown in FIG. 3, the annular rib 15 includes an upper surface 16 extending downwardly and inwardly, an arcuate free end 17 and a downwardly and inwardly extending surface 18 extending toward the threads.

The closure is preferably made of moldable organic plastic such as polypropylene, polyethylene, or copolymers of these materials.

Figure 2:
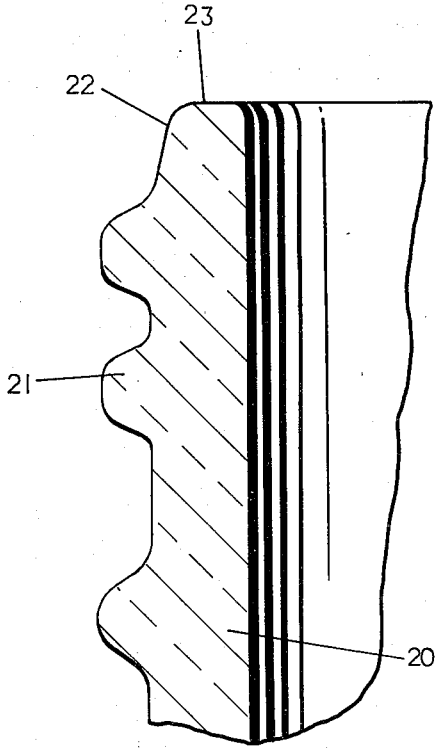
FIG. 2 is a fragmentary sectional view of a portion of a container embodying the invention.

As shown in FIG. 2, the container may be made of plastic, but is preferably made of glass and has a neck 20 formed with external threads 21, a frustoconical surface 22 above the threads extending upwardly and inwardly, and a flat top sealing surface 23.

The panel 11 of the closure is formed with a downwardly extending complementary annular surface 24 for engaging the top surface 23.

Figure 4:
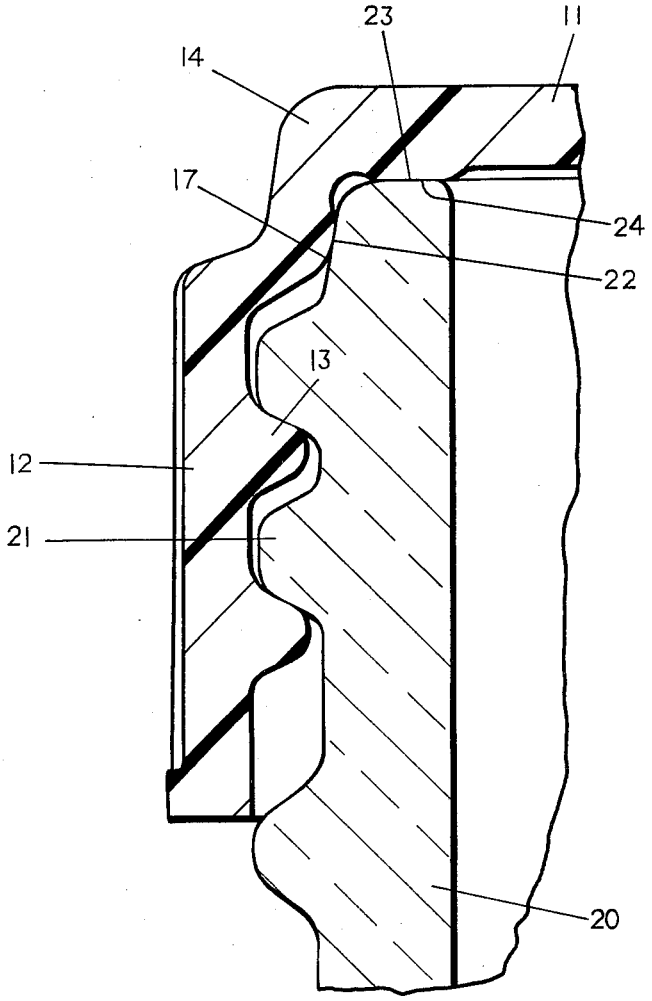
FIG. 4 is a fragmentary sectional view on an enlarged scale of the closure applied to the container.

When the closure is applied to the container and threaded thereon, the relatively rigid top portion 24 is brought into engagement with the flat surface 23 of the container. Rib 15 is dimensioned to provide an interference fit with the frustoconical surface 22. As the closure is tightened, the rib 15 provides a seal. Continued threading of the closure on the container flexes the wall 14 into the configuration shown in FIG. 4 so that the wall 14 is under stress.

After the closure has been applied to the container and pressure within the container increases, the panel 11 may flex upwardly and assume a configuration causing the sealing portion 24 to move away from the sealing surface 23. However, this displacement of the panel will not affect the compressing force of the rib 15 on the frustoconical surface 22 but rather will increase the effectiveness through the further flexing of the wall 14.

Similarly, if the package is utilized in packaging products under vacuum, which causes panel 11 to flex downwardly, enhanced side sealing is provided between the rib 15 and wall 14.

I claim:

1. A package for pressure fluid containment comprising a container having a neck defining annular wall about the center axis of the container with external threads formed along said wall thereon, an external, frustoconical sealing surface (22) formed above said threads and sloped upwardly and radially inwardly toward said center axis and a flat annular top surface (23) defining the mouth opening of the container, a plastic closure comprising a top panel section, and an integral depending annular skirt section defining internal threads to cooperate with the complementary threads on the neck of the container, an annular side sealing rib forming a series connected part of said skirt section extending radially inwardly from the inside surface of said skirt above said threads and having an internal surface dimensioned to form an interference fit only with said external frustoconical sealing surface of the container such that when the closure is threaded on the container, the rib is compressed into sealing relation with the external frustoconical sealing wall, means on said panel section comprising a downwardly extending annular portion (24) for engaging the annular top surface of said container finish to form a top seal with the flat top surface of the container neck, and an axially extending flexible annular wall section integrally connecting the periphery of said top panel section and said side sealing rib, said flexible annular wall section extending upwardly and inwardly from said rib to said panel section, and said wall section being of less thickness than said panel and said annular side sealing rib, whereby increasing internal container pressure on said top panel section increases the radial compressing force on said side sealing rib.

2. The package set forth in claim 1 wherein said annular rib includes a first radial surface extending downwardly and radially inwardly, a second arcuate surface, and a third surface extending radially outwardly and downwardly toward the threads.

* * * * *